US006896129B2

(12) United States Patent
Marco

(10) Patent No.: US 6,896,129 B2
(45) **Date of Patent: *May 24, 2005**

(54) BANDED CONTAINER PACKAGE WITH OPENING FEATURE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/396,610

(22) Filed: Mar. 25, 2003

(65) Prior Publication Data

US 2004/0055907 A1 Mar. 25, 2004

Related U.S. Application Data

(63) Continuation-in-part of application No. 10/301,212, filed on Nov. 21, 2002, which is a continuation-in-part of application No. 10/251,312, filed on Sep. 20, 2002.

(51) Int. Cl.[7] ..... B65D 75/00
(52) U.S. Cl. ..... 206/150; 206/155; 206/434
(58) Field of Search ..... 206/141, 143, 206/145, 147, 148, 149, 150, 151, 155, 162, 163, 427, 428, 429, 431, 432, 434

(56) References Cited

U.S. PATENT DOCUMENTS

| | | | | |
|---|---|---|---|---|
| 2,359,297 | A | | 10/1944 | Brogden |
| 3,084,792 | A | | 4/1963 | Poupitch |
| 3,118,537 | A | | 1/1964 | Copping |
| 3,186,544 | A | | 6/1965 | Curry et al. |
| 3,302,783 | A | | 2/1967 | Lyon |
| 3,330,408 | A | | 7/1967 | Wanderer |
| 3,385,429 | A | | 5/1968 | Becker et al. |
| 3,447,675 | A | | 6/1969 | Kirby |
| 3,504,790 | A | | 4/1970 | Owen |
| 3,509,684 | A | | 5/1970 | Hohl et al. |
| 3,515,272 | A | | 6/1970 | Von Gal |
| 3,570,663 | A | | 3/1971 | Cunningham |
| 3,687,282 | A | | 8/1972 | Owen |
| 3,700,275 | A | | 10/1972 | Deasy |
| 3,721,337 | A | | 3/1973 | Braun et al. |
| 3,734,280 | A | | 5/1973 | Amneus et al. |
| 3,784,003 | A | | 1/1974 | Bolton |
| 3,923,155 | A | | 12/1975 | Tanzer |
| 4,066,166 | A | | 1/1978 | Klygis |
| 4,099,616 | A | * | 7/1978 | Klygis ..... 206/427 |
| 4,121,401 | A | | 10/1978 | Duerr et al. |
| 4,269,308 | A | | 5/1981 | Platt |
| 4,289,236 | A | | 9/1981 | Ganz et al. |
| 4,296,858 | A | | 10/1981 | Platt |
| 4,300,681 | A | | 11/1981 | Klygis et al. |
| 4,354,333 | A | | 10/1982 | McArdle |
| 4,385,690 | A | | 5/1983 | Olsen |
| 4,386,698 | A | | 6/1983 | Klygis |
| 4,460,084 | A | | 7/1984 | Miller |
| 4,471,870 | A | | 9/1984 | Uhlig |
| 4,520,924 | A | | 6/1985 | Edwards et al. |
| 4,523,676 | A | | 6/1985 | Barrash |
| D286,020 | S | | 10/1986 | Barrash |
| 4,628,666 | A | | 12/1986 | Lems |
| 4,807,751 | A | | 2/1989 | Klygis et al. |

(Continued)

FOREIGN PATENT DOCUMENTS

| | | | |
|---|---|---|---|
| WO | WO 99/67138 | 12/1999 | ..... B65B/61/14 |

*Primary Examiner*—Shian T. Luong
(74) *Attorney, Agent, or Firm*—Taylor & Aust, P.C.

(57) ABSTRACT

A package for containers such as beverage bottles and cans includes a carrier with an array of loops, one loop provided for surrounding each container. A sleeve surrounds the group of containers held by the carrier. The carrier includes perforations, slits and frangible links for tearing the carrier and releasing containers individually. The sleeve includes a parting line allowing separation of the sleeve to release the containers.

13 Claims, 7 Drawing Sheets

U.S. PATENT DOCUMENTS

| | | | | |
|---|---|---|---|---|
| 4,815,589 | A | | 3/1989 | Allen et al. |
| 4,828,110 | A | | 5/1989 | Lems |
| 4,893,712 | A | | 1/1990 | Allen |
| 4,919,265 | A | | 4/1990 | Lems et al. |
| 4,932,528 | A | | 6/1990 | Benno |
| 5,154,289 | A | | 10/1992 | Van Erden |
| 5,425,446 | A | | 6/1995 | Weaver et al. |
| 5,437,370 | A | | 8/1995 | Marco |
| 5,452,794 | A | | 9/1995 | DiVietro |
| 5,467,870 | A | | 11/1995 | Broskow et al. |
| 5,487,463 | A | | 1/1996 | Harris |
| 5,505,304 | A | | 4/1996 | Broskow et al. |
| 5,524,756 | A | * | 6/1996 | Sutherland ..... 206/434 |
| 5,642,808 | A | | 7/1997 | Marco et al. |
| 5,701,994 | A | | 12/1997 | Marsh |
| 6,145,656 | A | | 11/2000 | Marco |
| 6,213,293 | B1 | | 4/2001 | Marco |
| 6,536,656 | B2 | * | 3/2003 | Auclair et al. ..... 229/117.13 |

* cited by examiner

BANDED CONTAINER PACKAGE WITH OPENING FEATURE

CROSS REFERENCE TO RELATED APPLICATION

The present application is a continuation-in-part of co-pending U.S. patent application Ser. No. 10/301,212 filed on Nov. 21, 2002, which is a continuation-in-part of co-pending U.S. patent application Ser. No. 10/251,312 filed on Sep. 20, 2002.

FIELD OF THE INVENTION

The present invention relates to packages for groups of containers, and, more particularly, to opening features for container packages including plastic carriers having arrays of loops for engaging and holding individual containers, and sleeves surrounding the groups of containers.

BACKGROUND OF THE INVENTION

Container carriers are used frequently to unitize a plurality of containers, such as bottles or cans, into conveniently saleable quantities. Both paperboard and plastic are materials commonly used. Paperboard carriers generally comprise a box in which the containers are held. The box may be totally enclosed, or may have an open top, with individual compartments for each container. Disadvantages of paperboard carriers include excess material and cost. Further, once opened, an enclosed box no longer holds the containers securely. An open top carrier can spill the contents therein, if inverted.

Plastic carriers have achieved wide acceptance for their performance, low weight, low cost and versatility in being adapted for containers of different sizes and shapes. The general design for plastic carriers includes apertures in a stretchable plastic material. The apertures are sized and shaped to stretch around the periphery of the containers to be held, either bottles or cans. For convenient carrying of a group of containers held by the carrier, various types of hand-grasps are known. Automated machinery is available for attaching stretchable plastic carriers to containers quickly and efficiently.

In one such known design, the carrier is formed from two webs of plastic material juxtaposed over one another. Handle portions and container engaging portions are stamped from the juxtaposed webs simultaneously. The webs are fused or welded along selected portions, such as by lamination. The resulting handle portion is thereby a double thickness of material, and the container engaging portions freely depend from the remainder of the carrier, at each side thereof. The container engaging portions are a single ply of material.

A problem experienced with some plastic carriers of this type is releasing the containers from the carrier. Prying or twisting one of the containers from the aperture in which it is held can be difficult, and the sudden release of a container can jar adjacent containers, causing other containers to be released in addition to the desired container.

A container carrier having a release feature allowing each container to be released individually, while retaining the remaining containers secured, is known from U.S. Pat. No. 5,642,800. This patent, which is commonly owned with the present invention, teaches a carrier having a plurality of apertures each for holding a separate container. An outer margin portion of the carrier includes a series of perforate lines and slits along which the outer margin portion can be torn. The slits are spaced from the perforate lines by a breakable link area to redirect the tearing force from one tear-completed perforate line to the next adjacent untorn perforate line. Tearing the margin portion along the perforate lines successively releases first one of the containers, and then another, until all containers are released.

A trend in the beverage industry is to group larger quantities of containers for sale. A large group of containers, whether bottles or cans, secured only by stretchable rings in an array of a plastic carrier, might have a feel of instability, with individual containers allowed to skew or twist relative to other containers in the group. Even with smaller quantities of containers, such as six-packs, the feeling of insecurity can occur as the containers twist and skew while being carried.

In co-pending, commonly owned U.S. patent application Ser. No. 10/251,312, plastic carrier is provided with an array of rings, including one ring for each container, and a stretchable sleeve for surrounding and securing the group of containers. If a carrier having the easy opening feature described above is used, it is difficult to operate the release feature as the carrier array is nested within the sleeve, and the sleeve interferes with the tearing aspect of the carrier. Removing the sleeve should be intuitive and simple, requiring no tools such as knives or scissors.

What is needed in the art is a well-secured container package that has an easy and convenient opening feature.

SUMMARY OF THE INVENTION

The present invention provides a plastic carrier with an array of rings having one ring for each container, and a stretchable sleeve for surrounding and securing the group of containers. The carrier has outer margin portions with tear lines for releasing the containers, and the sleeve has at least one parting line that opens to release the packaged containers from the sleeve.

In one form thereof, the invention provides a package for a group of containers including individual containers to be held in rows. The package has an integral plastic carrier including a container holding portion of interconnected stretchable loops, one loop for each container. Each loop surrounds a different one of the containers. The container holding portion has a margin extending along the loops, the margin adapted for tearing to individually release containers held by the carrier. A sleeve of stretchable material surrounds the group of containers, and has first and second edges and at least one parting line adapted for separation to release the containers from the sleeve. The at least one parting line has an end near at least one of the edges for causing a separation of the sleeve through the at least one edge In another form thereof, the invention provides a package of containers with a carrier including a plurality of loops, and a group of containers, one container disposed and secured in each loop. An outer margin portion on the carrier is adapted to be torn to release individual containers. A stretchable sleeve surrounds the group of containers. The sleeve has first and second edges and at least one parting line adapted for separation to release the containers from the sleeve. The at least one parting line has an end near at least one of the edges for causing a separation of the sleeve through the at least one edge.

In a further form thereof, the invention provides a sleeve for a group of containers held in a carrier of stretchable plastic defining loops for surrounding each container. The sleeve comprises a band of stretchable material for surrounding the group. The band has first and second edges; and at least one parting line in the band has an end near at least one of the edges for causing separation of the band through the at least one edge.

An advantage of the present invention is providing a package that retains individual containers in a secure manner, while allowing selective release of fewer than all containers.

Another advantage of the present invention is providing a container package with a visual cue to the operation of individual release functions for the containers.

Still another advantage of the present invention is providing a banded container package in which a sleeve surrounding the containers can be removed without releasing individual containers from a carrier.

A further advantage of the present invention is providing a container package including a carrier and a sleeve useful for grouping containers of various types.

Other features and advantages of the invention will become apparent to those skilled in the art, upon review of the following detailed description, claims and drawings, in which like numerals are used to designate like features.

Figure 1:
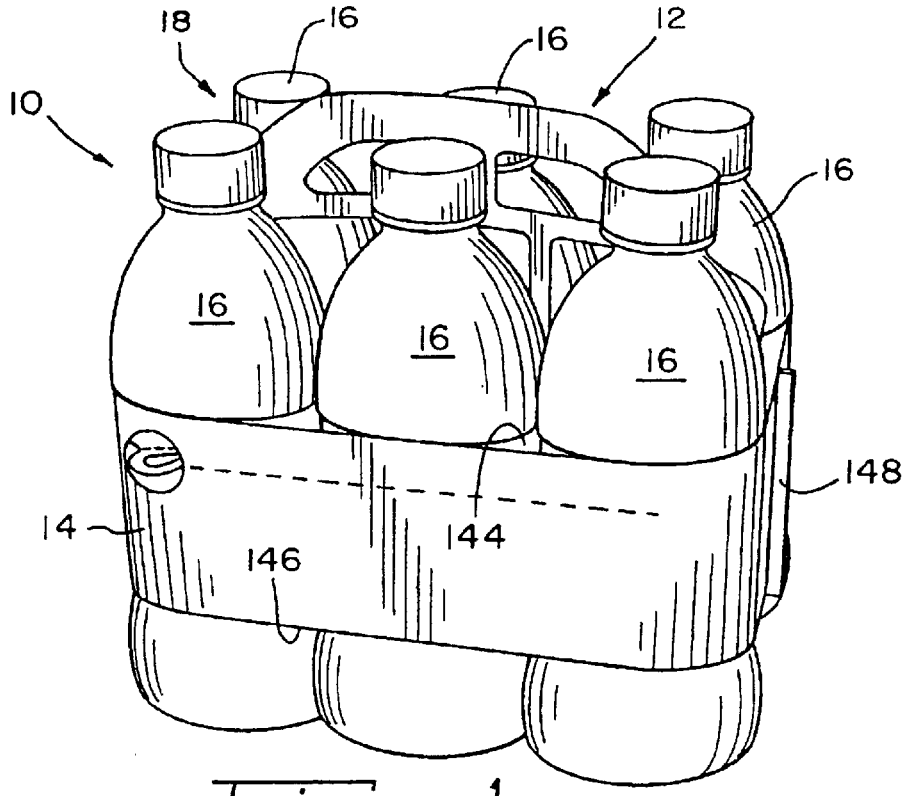
FIG. 1 is a perspective view of a container package in accordance with the present invention.

Before the embodiments of the invention are explained in detail, it is to be understood that the invention is not limited in its application to the details of construction and the arrangements of the components set forth in the following description, or illustrated in the drawings. The invention is capable of other embodiments and of being practiced or being carried out in various ways. Also, it is understood that the phraseology and terminology used herein are for the purpose of description, and should not be regarded as limiting. The use herein of "including" and "comprising", and variations thereof is meant to encompass the items listed thereafter, and equivalents thereof, as well as additional items and equivalents thereof.

DETAILED DESCRIPTION OF THE PREFERRED EMBODIMENT

Figure 7:
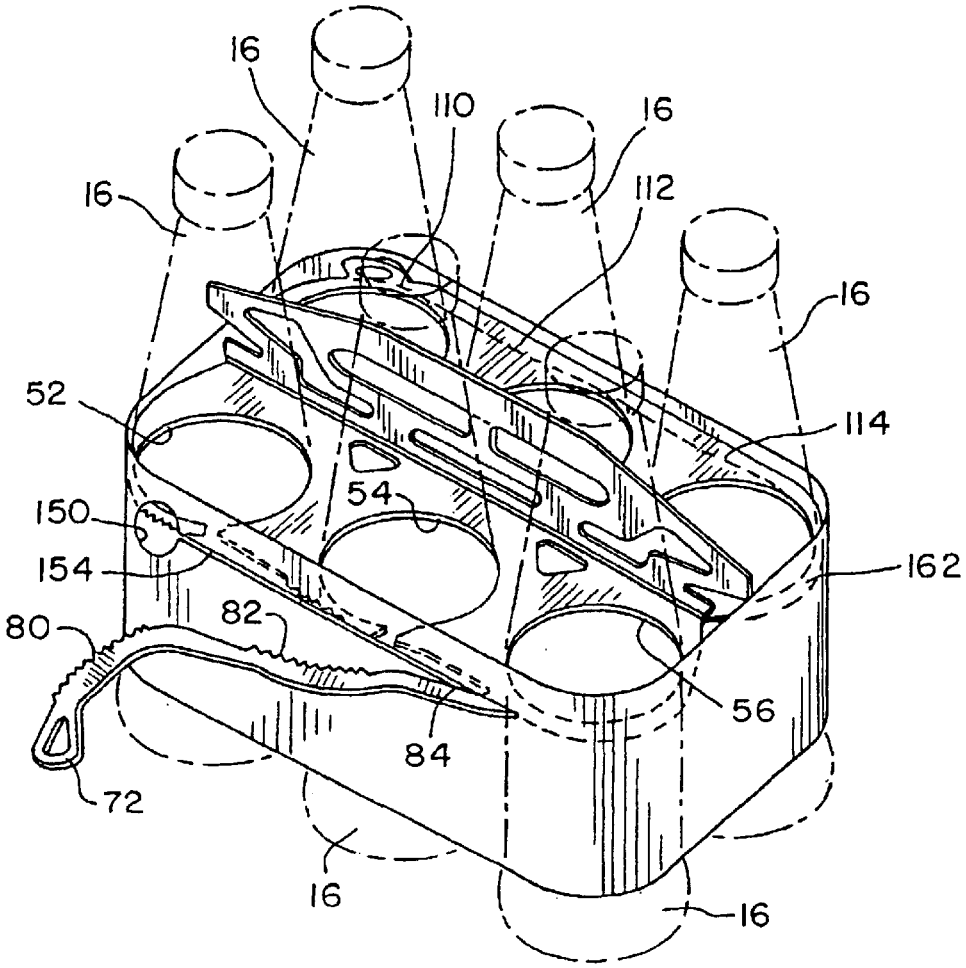
FIG. 7 is perspective view of a container package, with containers different from those in the previous Figures shown in phantom lines, illustrating the package torn to release containers on one side thereof.

Referring now more specifically to the drawings, and to FIG. 1 in particular, a container package 10 in accordance with the present invention is shown. Package 10 includes a carrier 12 and a sleeve 14. In the exemplary embodiment shown in the drawings, package 10 is provided for a so-called six-pack, and is shown for packaging a plurality of individual containers 16 into a group 18 of containers 16. However, it should be understood that the present invention can be used advantageously for packaging more or fewer containers 16 than the six-pack shown. Further, while package 10 is illustrated for packaging individual containers 16 in the form of bottles, package 10 can be used for packaging containers 16 other than bottles. For example, package 10 can be used also for packaging cans, and for bottles of different shapes. FIG. 7 illustrates containers 16 in phantom lines, of a shape different than containers 16 shown in FIG. 1.

Figure 2:
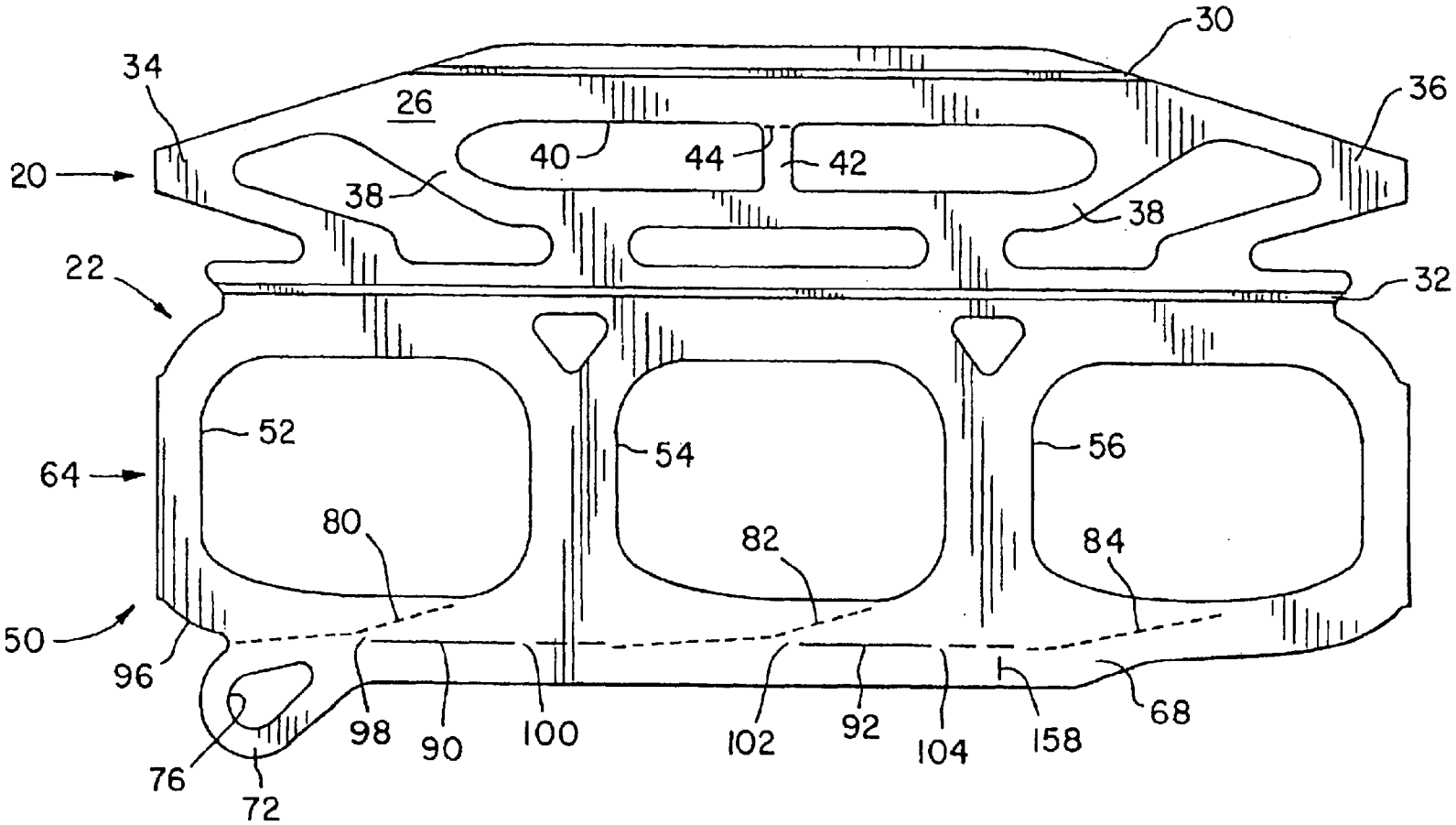
FIG. 2 is an enlarged plan view of a carrier in the container package shown in FIG. 1.
Figure 4:
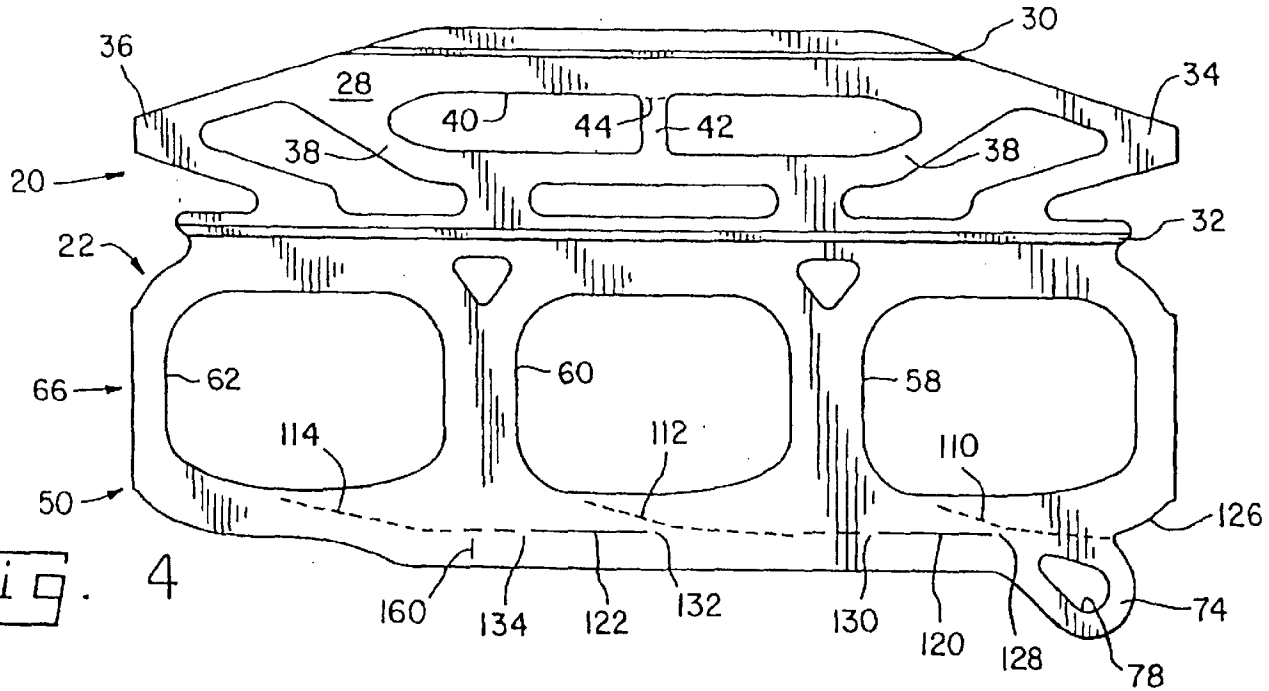
FIG. 4 is an enlarged plan view of the carrier shown in FIG. 2, but illustrating the side opposite the side shown in FIG. 2.

With reference to FIGS. 2 and 4, opposite sides of carrier 12 are illustrated. Carrier 12 includes a handle and suspension portion 20 and a container holding portion 22. The configuration of carrier 12 will vary depending on the size, type and quantity of containers 16 to be held in carrier 12. In a preferred design for carrier 12 to hold a six pack as illustrated, carrier 12 is a two-ply structure having a first sheet 26 (FIG. 2) and second sheet 28 (FIG. 4) juxtaposed on each other. First sheet 26 and second sheet 28 are connected by one or more welds 30, 32, two such welds 30 and 32 shown in the drawings. The manner in which such welds can be made is well known to those skilled in the art, and may include the application or extrusion of material between first sheet 26 and second sheet 28, to cause the sheets to fuse together. As illustrated, welds 30 and 32 are provided, respectively, near a top of handle portion 20 and a near container holding portion 22. An additional weld or welds may be provided between those illustrated. Handle portion 20, and container holding portion 22 are formed as integral portions of each sheet 26 and 28. Welds 30, 32 bond sheets 26 and 28 such that the portions 20 and 22 form a single integral carrier 12.

Handle portion 20 is a double thick layer that includes a plurality of struts 34, 36 and 38, including first and second end struts 34 and 36, respectively, and a plurality of intermediate struts 38 formed in each first sheet 26 and second sheet 28. Handle portion 20 further includes a handle opening 40 formed through the double layer of first sheet 26 and second sheet 28. A tie 42 interconnects the top and bottom of handle opening 40 during manufacture, to keep carrier 12 flat. Tie 42 ruptures readily along a perforate line 44 when container package 10 is lifted, making handle portion 12 more readily accessible and comfortable in use.

Container holding portion 22 comprises an array 50 of individual loops 52, 54, 56, 58, 60 and 62 generally below handle portion 20. As those skilled in the art will understand, each of loops 52, 54, 56, 58, 60 and 62 is a single-ply layer of material, with a first row 64 thereof, including loops 52, 54 and 56 being formed in first sheet 26 and a second row 66 thereof, including loops 58, 60 and 62 being formed in second sheet 28.

Each loop 52, 54, 56, 58, 60 and 62 is configured to be stretched and totally surround an individual container 16. The material for sheets 26 and 28 is both flexible and resilient, permitting significant stretching without breaking. Low-density polyethylene is a suitable plastic from which carrier 12 can be made.

Sheet 26 is provided with an outer margin portion 68, extending along loops 52, 54 and 56, and sheet 28 is provided with an outer margin portion 70 extending along loops 58, 60 and 62. Margin portions 68 and 70 define tabs 72 and 74, respectively, at one end thereof. In the embodiment illustrated, tabs 72 and 74 are provided at the same end of carrier 12. Tabs 72 and 74 are provided to be grasped by the consumer, and can define holes 76 and 78, respectively, to facilitate griping by the consumer.

Lines of perforations 80, 82 and 84 (FIG. 2) are provided in margin portion 68, angling toward loops 52, 54 and 56, respectively. An elongated slit 90 extends from near perforations 80 to near perforations 82, and an elongated slit 92 extends from near perforations 82 to near perforations 84. Perforations 80, 82 and 84 are each a series of relatively short, spaced cuts through sheet 26, along which sheet 26 can be torn. Slits 90 and 92 are continuous, elongated cuts through sheet 26. Perforations 80 extend from an edge 96 of carrier 12 just above tab 72 toward the interior of loop 52. Perforations 82 extend from near slit 90 toward the interior of loop 54. Perforations 84 extend from near slit 92 toward the interior of loop 56. Frangible links 98 and 100 are provided between perforations 80 and slit 90, and between slit 90 and perforations 82, respectively. Frangible links 102 and 104 are provided between perforations 82 and slit 92, and between slit 92 and perforations 84, respectively.

Lines of perforations 110, 112 and 114 (FIG. 4) are provided in margin portion 70, angling toward loops 58, 60 and 62, respectively. An elongated slit 120 extends from near perforations 110 to near perforations 112, and an elongated slit 122 extends from near perforations 112 to near perforations 114. Perforations 110, 112 and 114 are each a series of relatively short, spaced cuts through sheet 28, along which sheet 28 can be torn. Slits 120 and 122 are continuous, elongated cuts through sheet 28. Perforations 110 extend from an edge 126 of carrier 12 just above tab 74 toward the interior of loop 58. Perforations 112 extend from near slit 120 toward the interior of loop 60. Perforations 114 extend from near slit 122 toward the interior of loop 62. Frangible links 128 and 130 are provided between perforations 110 and slit 120, and between slit 120 and perforations 112, respectively. Frangible links 132 and 134 are provided between perforations 112 and slit 122, and between slit 122 and perforations 114, respectively.

Referring now particularly to FIG. 1, sleeve 14 is formed as an endless band surrounding the perimeter of group 18 of containers 16 held by carrier 12. Sleeve 14 has a top edge 140 and a bottom edge 142, with an open top 144 and an open bottom 146. Containers 16 extend above top edge 140 and below bottom edge 142, through open top 144 and open bottom 146, respectively. Advantageously, sleeve 14 has a substantial height between top edge 140 and bottom edge 142, to provide a large billboard area to display information, and to provide greater stability to package 10. Sleeve 14 can be formed from a strip of stretchable material formed into an endless band by bonding ends of the strip at a seam 148.

Figure 3:
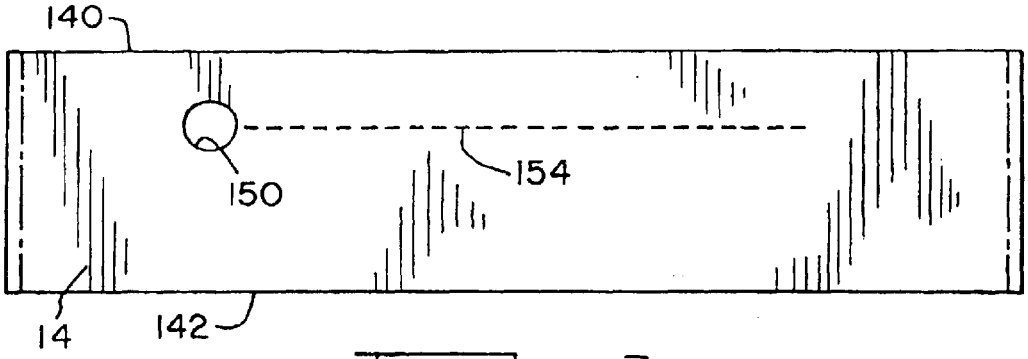
FIG. 3 is an elevational view of the sleeve shown in FIG. 1.
Figure 5:
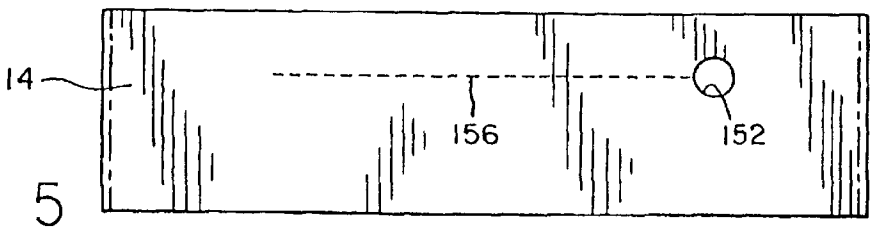
FIG. 5 is an elevational view of the sleeve, showing the side opposite the side shown in FIG. 3.

In a preferred structure of package 10, array 50 is disposed within sleeve 14. That is, loops 52, 54, 56, 58, 60 and 62 engage containers 16 at a position on containers 16 between the level of top edge 140 and bottom edge 142. To facilitate the release of individual containers 16, sleeve 14 is provided with apertures 150 and 152, and parting lines 154 and 156 extending therefrom (seen best in FIGS. 3 and 5). Apertures 150 and 152 are aligned with tabs 72 and 74 such that tabs 72 and 74 projected outwardly through apertures 150 and 152, respectively, allowing easy grasping thereof by a consumer. Parting lines 154 and 156 originate at apertures 150 and 152, respectively, and extend along sleeve 14, generally in line with margin portions 68 and 70, respectively. Parting lines 154 and 156 are spaced perforations, allowing relatively easy breaching of sleeve 14 from within sleeve 14, as tabs 72 and 74 are pulled during a release procedure, to be described in greater detail hereinafter.

In a contemplated procedure for using package 10, sleeve 14 is applied after carrier 12 has been attached to individual containers 16. Sleeve 14 is stretched to surround group 18 of containers 16, and is positioned there around to cover array 50 of carrier 12. The application of carrier 12 to individual containers 16 to form group 18, and the placement of sleeve 14 around group 18 can be performed with automated equipment known to those skilled in the art.

Sleeve 14 stabilizes group 18, minimizing the degree to which individual containers 16 can twist or skew relative to other containers 16 within group 18. The cooperative association of carrier 12 and sleeve 14 provides a firm, stable feel to the package, increasing the comfort and confidence of consumers carrying the package.

Figure 6:
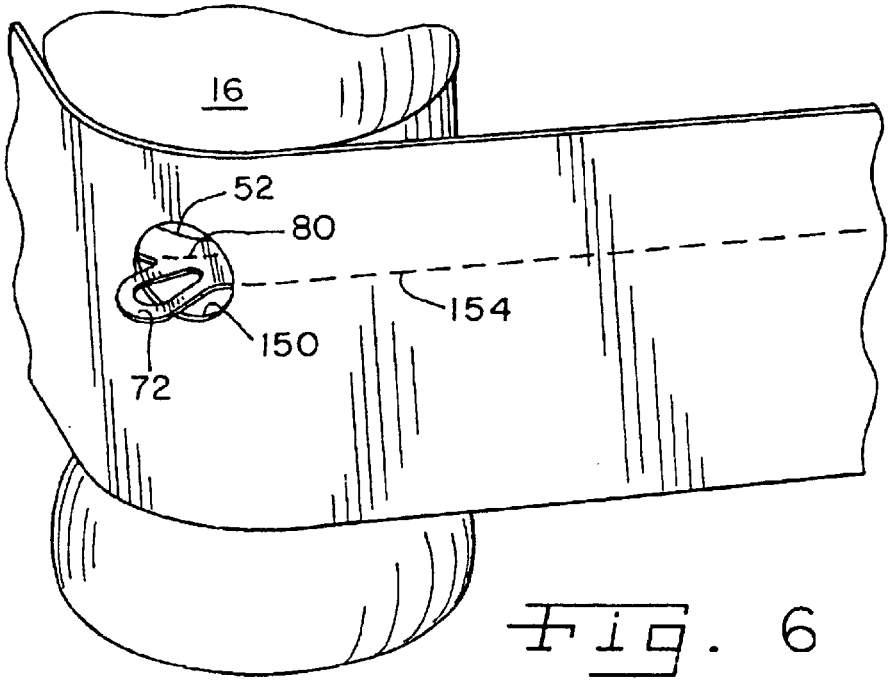
FIG. 6 is an enlarged perspective view of a portion of the container package shown in FIG. 1.

FIG. 7 illustrates the manner in which individual containers 16, illustrated as bottles 16 in phantom lines, are released from container package 10. Tab 72 projecting through aperture 150 (shown in enlarged detail in FIG. 6) is grasped and pulled to initiate tearing of margin portion 68. Tabs 72 and 74 projecting outwardly of relatively smooth surfaced sleeve 14 provide a strong visual clue of the presence of an opening feature, and the manner in which it is to be used. However, additionally sleeve 14 provides an area for printing instructions, which may be as simple as arrows adjacent apertures 150 and 152 indicating the direction in which tabs 72 and 74 should be pulled.

As tab 72 is pulled, margin portion 68 is tom along perforations 80, until loop 52 is breached. As the tear progresses along perforations 80, the separated length of outer margin portion 68 is pulled through sleeve 14, breaking along and through parting line 154.

A second container 16 can be released continuously or at some time subsequent to the release of the first container 16. Pulling of tab 72 is continued, breaking frangible link 98, opening slit 90 and breaking frangible link 100. Margin portion 68 is torn along perforations 82, until loop 54 is breached, and the second container is released. The additional separated length of outer margin portion 68 is pulled through sleeve 14 by breaking through yet a further length of parting line 154.

To release yet a third container 16, tab 72 is pulled still further, breaking frangible link 102, opening slit 92 and breaking frangible link 104. Margin portion 68 is torn along perforations 84, breaching loop 56 and releasing the third container 16. As additional lengths of outer margin portion 68 are separated, parting line 154 in sleeve 14 is broken further.

To release containers 16 held in loops 58, 60 and 62, a similar sequential process is followed, leading to the sequential breaching of loops 58, 60 and 62. Margin portion 70 is torn along perforations 110 to breach loop 58. Frangible links 128 and 130 are broken, and margin portion 70 is torn along perforations 112 to breach loop 60. Frangible links 132 and 134 are broken, and margin portion 70 is torn along perforations 114 to breach loop 62. As lengths of outer margin portion 70 are separated, parting line 156 in sleeve 14 is broken to allow outer margin portion 70 to be pulled away as necessary to break the frangible links and breach loops 58, 60 and 62 by tearing margin portion 70.

In the embodiment shown, the separated lengths of outer margin portions 68 and 70 remain attached to carrier 12 after the last container 16 is released on each side. Alternatively, additional perforations, a frangible link 158, 160 or the like can be provided in margin portions 68 and 70, respectively, allowing segments of margin portions 68 and 70 to be completely removed and discarded.

Figure 8:
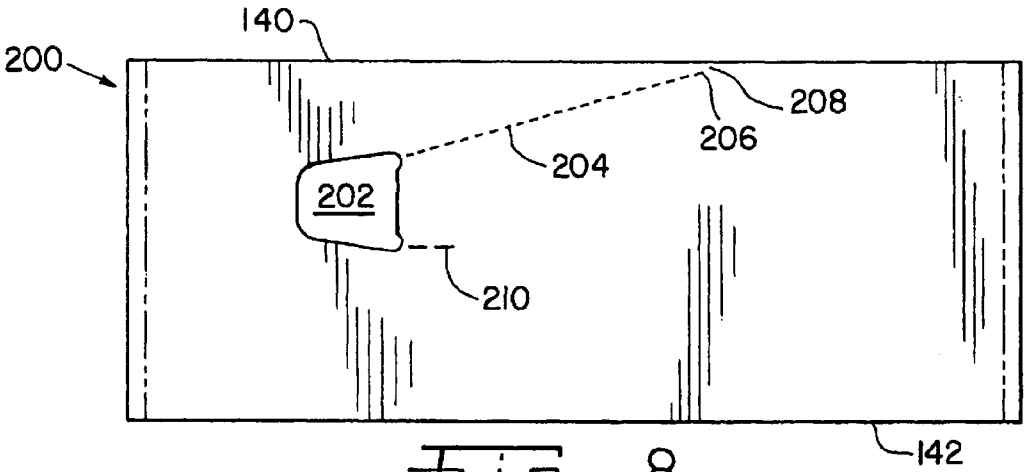
FIG. 8 is an elevational view of a modified sleeve of the present invention.

To facilitate removal of the sleeve, separation can occur along a parting line toward an edge of the band. For example, FIG. 8 illustrates a modified sleeve 200 in which an aperture 202 is provided, and a parting line 204 in the nature of spaced perforations or holes extends from an edge of aperture 202 to near upper edge 140 of sleeve 200. It is preferred that an end 206 of parting line 204 terminates some minimal distance from upper edge 140 to provide a non-perforated segment 208 between parting line end 206 and edge 140. As parting line 204 is separated, segment 208 is easily breached so that separation occurs through upper edge 140. However, until separation along parting line 204 is originated at aperture 202, segment 208 maintains the integrity of sleeve 114, minimizing the potential for separation propagating inwardly from upper edge 140. One or more slits 210 can be provided spaced from parting line 204 to facilitate the start of separation from aperture 202.

In the use of sleeve 200, tab 72 or tab 74 of carrier 12 projects outwardly from aperture 202, and is grasped and pulled to initiate tearing of sleeve 200 as described previously for sleeve 14. However, as separation occurs along parting line 204, the propagation thereof continues through segment 208 so that the integrity of sleeve 200 inwardly from upper edge 140 is breached. Bottles, cans or other containers are then removed easily, even though a lower portion of sleeve 200, above lower edge 142, remains substantially intact.

Figure 9:
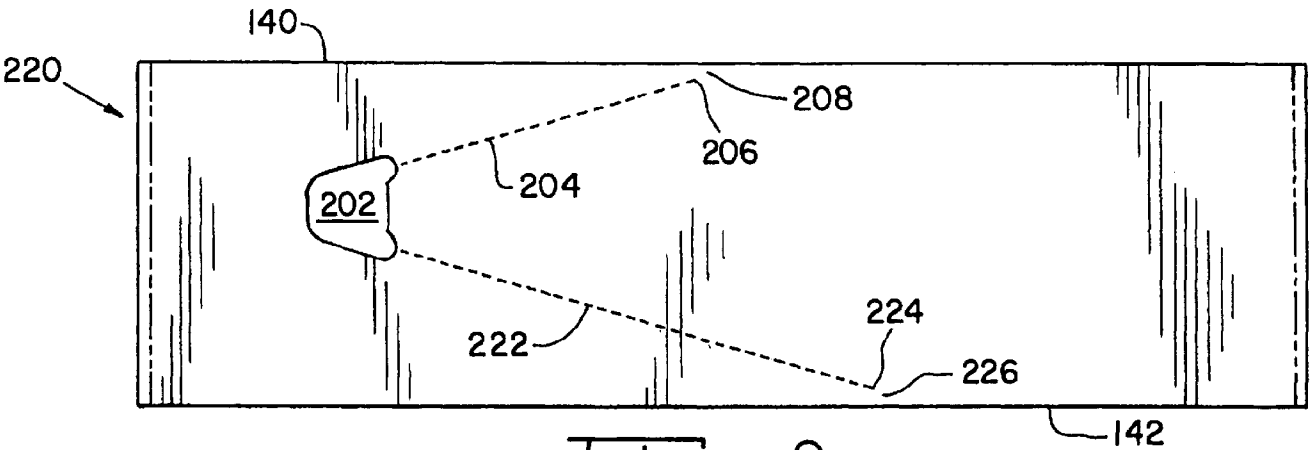
FIG. 9 is an elevational view of a further modified sleeve.

FIG. 9 illustrates yet another modified sleeve 220, shown longer than sleeve 200 but may also be of similar length, depending on the style, size and number of containers to be held thereby. Sleeve 220 includes a second parting line 222 that angles downwardly from aperture 202. Toward and near bottom edge 142, an end 224 of second parting line 222 is spaced from bottom edge 142, leaving a non-perforated segment 226 between end 224 and bottom edge 142. Segment 226 is provided for similar purposes and functions similarly to segment 208, described previously.

In the use of sleeve 220, again tab 72 or tab 74 of carrier 12 projects outwardly from aperture 202, and is grasped and pulled to initiate tearing of sleeve 220 substantially as described previously for sleeve 200. In sleeve 220, separation propagates along both parting line 204 and parting line 222 from aperture 202, and continues through segments 208 and 226 so that sleeve 220 becomes separated completely between upper edge 140 and lower edge 142. Sleeve 220 thereby easily falls away from a group of containers held therein, and sleeve 220 can be easily disposed of or recycled.

Figure 10:
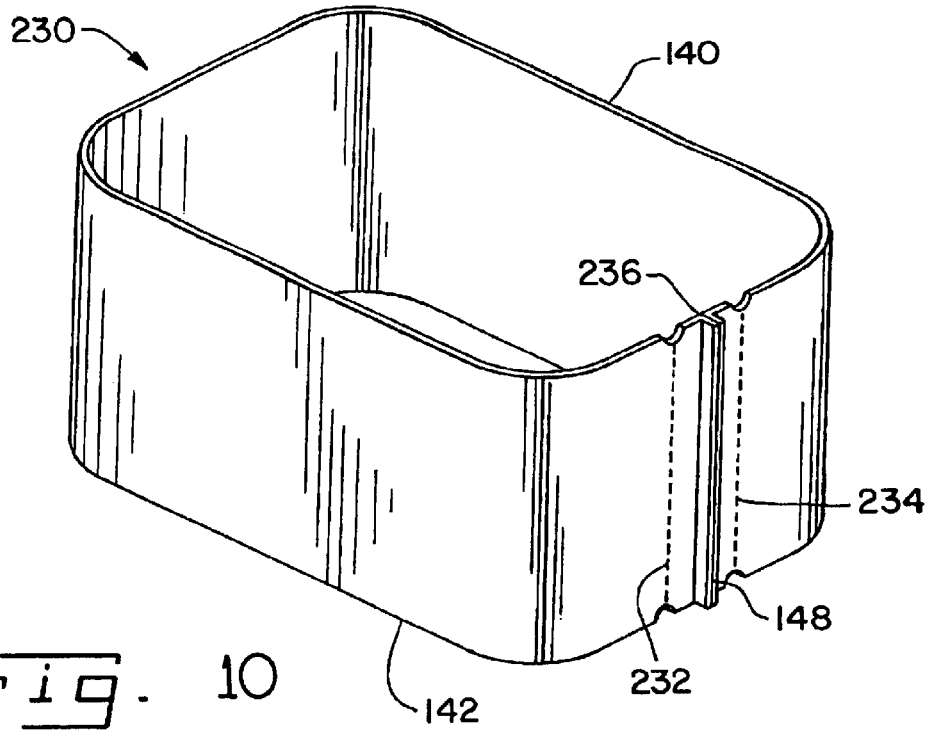
FIG. 10 is a perspective view of another modified sleeve.

It also is contemplated that for some container styles and for some packages, it may be advantageous to use a sleeve that can be separated from the package without separating any one of the containers from carrier 12. FIG. 10 illustrates a sleeve 230 in which first and second parting lines 232 and 234 extend substantially perpendicular to upper edge 140 and lower edge 142. Tearing simultaneously along parting lines 232 and 234 removes a sleeve strip 236 between parting lines 232 and 234, thereby allowing sleeve 230 to be removed from the package of containers while each container remains securely held by a carrier.

Figure 11:
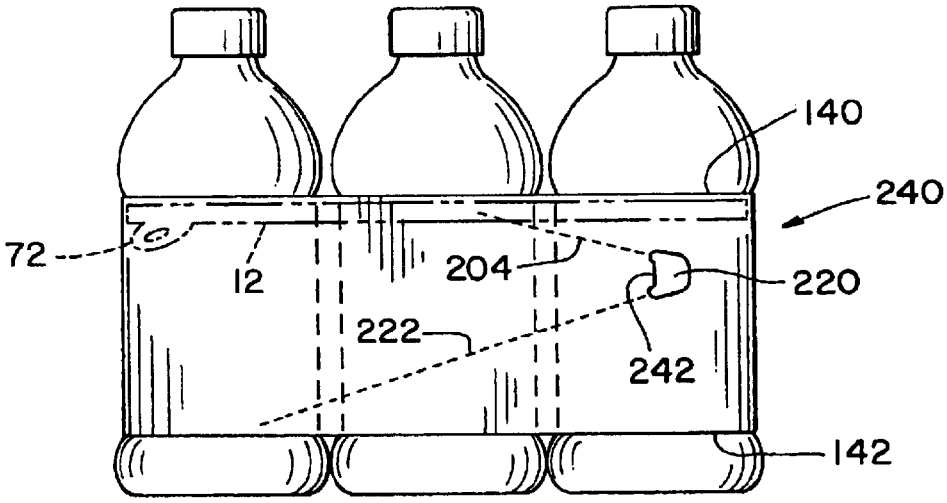
FIG. 11 is a perspective view of still another modified sleeve.

FIG. 11 illustrates yet another embodiment similar to that illustrated in FIG. 9. However, a sleeve 240 includes a sleeve tab 242 that projects into aperture 202, between parting lines 204 and 222. As illustrated, it is not necessary for carrier tab 72 or carrier tab 74 to project outwardly through aperture 202. Instead, sleeve 240 is positioned to cover tabs 72 and 74, as illustrated in phantom lines. To propagate separation along parting lines 204 and 222, sleeve tab 242 is grasped and pulled away from aperture 202, thereby tearing the sleeve along parting lines 204 and 222 through upper and lower edges 140 and 142, as described previously. Again, the sleeve can be removed without compromising the security of the containers held in carrier 12.

Figure 12:
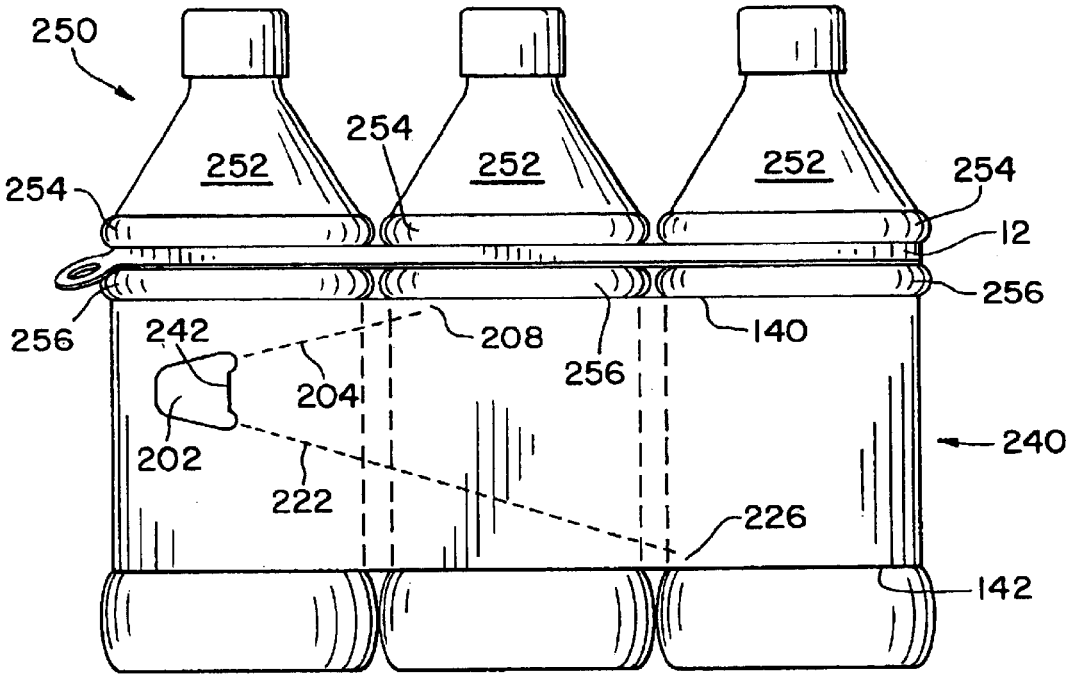
FIG. 12 is a fragmentary view of a modified package including bottles, a carrier and a sleeve in accordance with the present invention.

For security and aesthetics, it is anticipated in many applications of the present application sleeves 14, 200, 220, 230 and 240 will surround carrier 12 such that the carrier loops surrounding the containers are not exposed. In many of the examples and embodiments described previously it is necessary for carrier 12 to be within the confines of sleeve 14, 200 or 220 in that the carrier and the sleeve are separated from containers simultaneously, and the carrier margin is used to assist in separation of the sleeve. However, in embodiments of the sleeve which do not rely on separation of the carrier to tear the sleeve, such as those illustrated in FIGS. 10 and 11, it is suitable for the carrier and sleeve to be disposed in spaced relation on containers in the package. This may be particularly advantageous for various sculpted forms of containers. FIG. 12 illustrates an embodiment of a package 250 of containers 252 in which each container 252 includes spaced circumferential ribs 254 and 256. Carrier 12 is attached to each container 252 between circumferential ribs 254 and 256 thereof. Sleeve 240 is disposed on containers 252 below and in spaced relationship to carrier 12.

The present invention provides improved stability by providing an encircling band for stabilizing containers held in a carrier, with cooperative association of the carrier and band in facilitating the release of a single container, or several containers in succession. The invention further provides a packaging arrangement in which sleeve and carrier can be removed from the containers independently.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention, and will enable others skilled in the art to utilize the invention. The claims are to be construed to include alternative embodiments to the extent permitted by the prior art.

Various features of the invention are set forth in the following claims.

What is claimed is:

1. A package for a group of containers including individual containers to be held in rows, said package comprising;

an integral plastic carrier including a container holding portion of interconnected stretchable loops, one said loop for each said container, each said loop surrounding a different one of said containers, said container holding portion having a margin extending along said loops, said margin adapted for tearing to individually release containers held by said carrier;

a sleeve of stretchable material surrounding the group of containers, said sleeve having first and second edges and at least one parting line adapted for separation to release said containers from said sleeve, said at least one parting line having an end near at least one said edge for causing a separation of said sleeve through said at least one edge;

said margin defining a tab and a plurality of lines of perforations arranged in succession along said margin, one said line of perforations extending toward each said loop, said sleeve defining an aperture, said tab projecting outwardly through said aperture, and said at least one parting line originating at said aperture, and being spaced perforations in said sleeve.

2. The package of claim 1, said sleeve having two said parting lines originating at said aperture;

one said parting line angling from said aperture toward one of said edges and the other said parting line angling from said aperture toward the other of said edges.

3. A package for a group of containers including individual containers to be held in rows, said package comprising;

an integral plastic carrier including a container holding portion of interconnected stretchable loops, one said loop for each said container, each said loop surrounding a different one of said containers, said container holding portion having a margin extending along said loops, said margin adapted for tearing to individually release containers held by said carrier;

a sleeve of stretchable material surrounding the group of containers, said sleeve having first and second edges and at least one parting line adapted for separation to release said containers from said sleeve, said at least one parting line having an end near at least one said edge for causing a separation of said sleeve through said at least one edge; and said sleeve defining an aperture and two said parting lines, each said parting line angling from said aperture toward a different one of said edges.

4. The package of claim 3, said sleeve defining a sleeve tab between said parting lines, said sleeve tab projecting into said aperture.

5. The package of claim 4, each said parting line being spaced perforations in said sleeve.

6. A package of containers comprising;

a carrier including a plurality of loops;

a group of containers, one said container disposed and secured in each said loop;

an outer margin portion adjacent said loops adapted to be torn to release individual containers;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and said margin defining a tab and a plurality of lines of perforations arranged in succession along said margin, one said line of perforations extending toward each said loop, said sleeve defining an aperture, said tab projecting outwardly through said aperture, and said at least one parting line originating at said aperture, and being spaced perforations in said sleeve.

7. The package of containers of claim 6, said sleeve having two said parting lines originating at said aperture;

one said parting line angling from said aperture toward one of said edges and the other said parting line angling from said aperture toward the other of said edges.

8. A package of containers comprising;

a carrier including a plurality of loops;

a group of containers, one said container disposed and secured in each said loop;

an outer margin portion adjacent said loops adapted to be torn to release individual containers;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and said outer margin portion having a tab, said sleeve defining an aperture adjacent said parting line, and said tab projecting through said aperture.

9. A package of containers comprising;

a carrier including a plurality of loops;

a group of containers, one said container disposed and secured in each said loop;

an outer margin portion adjacent said loops adapted to be torn to release individual containers;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and said sleeve defining an aperture and two said parting lines, each said parting line angling from said aperture toward a different one of said edges.

10. The package of containers of claim 9, said sleeve defining a sleeve tab between said parting lines, said sleeve tab projecting into said aperture.

11. The package of containers of claim 10, said carrier and said sleeve disposed on said group of containers in spaced relation.

12. A sleeve for a group of containers held in a carrier of stretchable plastic defining loops for surrounding each container, said sleeve comprising;

a band of stretchable material for surrounding the group, said band having first and second edges;

at least one parting line in said band having an end near at least one of said edges for causing separation of said band through said at least one edge; and said band including an aperture and two said parting lines, each said parting line comprising a perforate line originating at said aperture, each parting line angling from said aperture toward a different one of said edges.

13. The sleeve of claim 12, said sleeve defining a sleeve tab between said parting lines, said sleeve tab projecting into said aperture.

* * * * *